US012428856B2

(12) United States Patent
Bladh

(10) Patent No.: US 12,428,856 B2
(45) Date of Patent: Sep. 30, 2025

(54) SET OF SURFACE COVERING PLANKS AND METHOD OF CONNECTING THEREOF

(71) Applicant: TARKETT GDL S.A., Lentzweiler (LU)

(72) Inventor: Jonas Bladh, Wiltz (LU)

( * ) Notice: Subject to any disclaimer, the term of this patent is extended or adjusted under 35 U.S.C. 154(b) by 267 days.

(21) Appl. No.: 17/909,238

(22) PCT Filed: Mar. 5, 2021

(86) PCT No.: PCT/EP2021/055641
§ 371 (c)(1),
(2) Date: Sep. 2, 2022

(87) PCT Pub. No.: WO2021/176078
PCT Pub. Date: Sep. 10, 2021

(65) Prior Publication Data

US 2023/0090055 A1 Mar. 23, 2023

(30) Foreign Application Priority Data

Mar. 6, 2020 (LU) ..... LU101663

(51) Int. Cl.
*E04F 15/02* (2006.01)

(52) U.S. Cl.
CPC ..... *E04F 15/02038* (2013.01); *E04F 2201/0146* (2013.01); *E04F 2201/023* (2013.01); *E04F 2201/042* (2013.01); *E04F 2201/043* (2013.01)

(58) Field of Classification Search
CPC ..... E04F 15/02038; E04F 2201/0146; E04F 2201/023; E04F 2201/042; E04F 2201/043; E04F 15/02033
(Continued)

(56) References Cited

U.S. PATENT DOCUMENTS 6,536,178 B1 * 3/2003 Pålsson ..... B44C 3/123 52/392
7,121,058 B2 * 10/2006 Palsson ..... E04F 15/04 52/273

(Continued)

FOREIGN PATENT DOCUMENTS

WO WO2005088029 9/2005

OTHER PUBLICATIONS

International Search Report dated May 19, 2021 in International Application No. PCT/EP2021/055641.

*Primary Examiner* — Brent W Herring
(74) *Attorney, Agent, or Firm* — B. Aaron Schulman, Esq.; Stites & Harbison, PLLC

(57) ABSTRACT

A set of planks (10) for covering a surface (12), comprising a first plank (16) having a first edge (24) defining a connecting tongue (26), and a second plank (18) having a second edge (28) defining a connecting groove (30), the first plank being movable between a disconnected position and a connected position, in which the connecting tongue is snap-fit in the connecting groove, the connecting tongue comprising a distal protrusion (40A) and a proximal protrusion (40B) adapted to abut upwards in the connected position against a proximal lip (42A) and a distal lip (42B) of the connecting groove. The second edge defines a guiding recess (38) at least partly located above the proximal lip (42A) for receiving the distal protrusion in an intermediate position of the first plank, in which the proximal protrusion abuts downwards against the distal lip.

14 Claims, 7 Drawing Sheets

Figure 1:
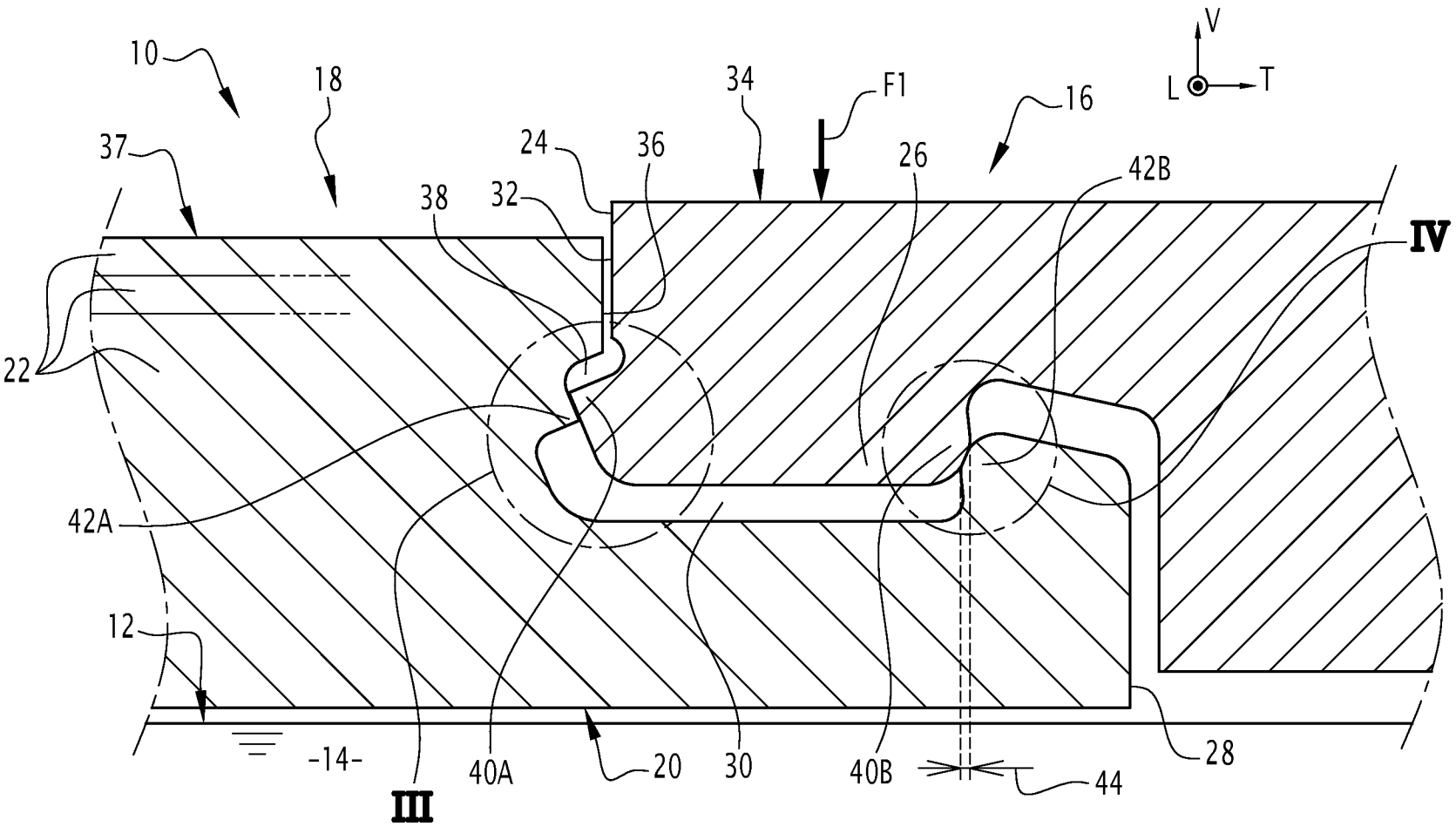

(58) Field of Classification Search
USPC ..... 52/589.1, 590.1, 590.2, 590.3, 592.2
See application file for complete search history.

(56) References Cited

U.S. PATENT DOCUMENTS

| | | | | |
|---|---|---|---|---|
| 11,365,546 | B2 * | 6/2022 | Ylikangas | E04F 15/02038 |
| 11,479,976 | B2 * | 10/2022 | Ylikangas | E04F 15/02038 |
| 11,987,991 | B2 * | 5/2024 | Claerhout | F16B 5/0056 |
| 2004/0250492 | A1 | 12/2004 | Becker | |
| 2006/0260253 | A1 | 11/2006 | Brice | |
| 2007/0022689 | A1 * | 2/2007 | Thrush | E04F 13/18 52/392 |
| 2010/0018147 | A1 | 1/2010 | Du | |
| 2014/0033633 | A1 * | 2/2014 | Kell | E04F 13/26 403/348 |
| 2017/0175401 | A1 * | 6/2017 | Kell | E04F 15/02033 |
| 2017/0241136 | A1 * | 8/2017 | Kell | E04F 15/02038 |
| 2017/0247890 | A1 | 8/2017 | Bladh et al. | |
| 2020/0063443 | A1 * | 2/2020 | Boucké | E04F 15/02038 |
| 2020/0232226 | A1 * | 7/2020 | De Rick | E04F 15/107 |
| 2020/0277796 | A1 * | 9/2020 | De Rick | E04F 15/02038 |
| 2020/0299973 | A1 * | 9/2020 | Boucké | E04F 15/02038 |
| 2020/0340254 | A1 * | 10/2020 | De Rick | E04F 15/107 |

* cited by examiner

SET OF SURFACE COVERING PLANKS AND METHOD OF CONNECTING THEREOF

BACKGROUND OF THE INVENTION

Field of the Invention

The present invention deals with a set of planks adapted to cover a surface perpendicular to a thickness direction of the planks, the planks having a lower face in the thickness direction intended to be in contact with the surface, and comprising at least a first plank having a first edge extending in a longitudinal direction perpendicular to the thickness direction, and a second plank having a second edge extending in the longitudinal direction, the second edge defining a connecting groove, and the first edge defining a connecting tongue, the first plank being movable with respect to the second plank between a disconnected position, in which the connecting tongue is away from the connecting groove, and a connected position, in which the connecting tongue is snap-fit in the connecting groove, the connecting tongue comprising two protrusions protruding in opposite senses in a transverse direction perpendicular to the thickness direction and to the longitudinal direction, the two protrusions including a transversely distal protrusion with respect to the first plank and a transversely proximal protrusion, the distal protrusion and the proximal protrusion being adapted to abut upwards in the connected position respectively against a transversely proximal lip and a transversely distal lip of the connecting groove.

Description of Related Art

The covered surface is usually a floor or a wall.

By "plank", it is meant a plank, a board or a tile.

These planks are provided with coupling parts allowing the connection of the planks with each other; these coupling parts are located at the edges of the planks and form connecting grooves and connecting tongues.

In such a set of planks, a first plank is snap-fit in a second plank by applying a vertical pressure F on the first plank. The connecting tongue of the first plank is adapted for being received vertically in the connecting groove of the second plank in the connected position.

During the vertical displacement of the first plank with respect to the second plank, there is an intermediate position in which the proximal protrusion of the connecting tongue abuts downwards against the distal lip of the connecting groove, forming a transverse overlap, while the distal protrusion of the connecting tongue transversely abuts against the proximal lip of the connecting groove.

In order to make sure that the planks cannot be disconnected too easily once they are in the connected position, the overlap is fairly large in the prior art planks, for example about 0.19 mm. As a result, the vertical pressure to be applied on the first plank during connection in order to overcome the resistance created by the overlap is rather strong. This makes the connection rather difficult for the user and also creates a risk of damaging the planks when applying such a pressure.

The quality of a connection system may be appreciated by its ease of installation, as well as by the strength of the connection once the planks are in the connected position.

The ease of installation depends in particular on the resistance that the user has to overcome: the higher the resistance, the more difficult the installation. The strength of the connection is a function of the resistance preventing the separation of the planks: the higher the resistance, the stronger the connection.

An aim of the invention is to provide a set of planks of an improved quality.

BRIEF SUMMARY OF THE INVENTION

To this end, the invention proposes a set of planks as described above, wherein the second edge further defines a guiding recess at least partly located above the proximal lip and adapted to receive the distal protrusion transversely in an intermediate position of the first plank, in which the proximal protrusion abuts downwards against the distal lip.

In other embodiments, the set of planks comprises one or several of the following features, taken in isolation or any technically feasible combination:

- in the intermediate position, the first plank is approximately parallel to the second plank;
- in the intermediate position, the proximal protrusion and the distal lip defines an overlap having a transverse extension smaller than 0.15 mm;
- a lower side of the guiding recess is at least partly defined by a surface of the second edge, said surface defining an angle with the thickness direction, the angle being smaller than 45°;
- a lower part of the proximal lip is at least partly defined by a surface of the second edge, said surface defining an angle with the thickness direction, the angle being larger than 45°;
- the proximal lip of the connecting groove also forms a lip of the guiding recess;
- the proximal lip and the distal protrusion are pointy, and the distal lip and proximal protrusion are round;
- the first edge and the second edge respectively comprise upper parts extending from upper faces of the first plank and the second plank in the thickness direction, the upper parts being parallel to the thickness direction;
- a lower part of the distal protrusion is at least partly defined by a surface of the first edge, said surface defining an angle with the thickness direction, the angle being smaller than 45°;
- an upper part of the distal protrusion is at least partly defined by a surface of the first edge, said surface defining an angle with the thickness direction, the angle being larger than 45°;
- a lower part of the distal lip is at least partly defined by a surface of the second edge, said surface defining an angle with the thickness direction, the angle being smaller than 10°;
- an upper part of the proximal protrusion is at least partly defined by a surface of the first edge, said surface defining an angle with the thickness direction, the angle being smaller than 10°; and
- at least one layer made from a rigid thermoplastic material, a plasticized thermoplastic material, a mineral material, or a wood based material.

The invention also relates to a method of connecting a set of planks as described above, comprising the following steps:

- moving the first plank with respect to the second plank from the disconnected position to the intermediate position, in which the distal protrusion is received transversely in the guiding recess and the proximal protrusion abuts downwards against the distal lip of the connecting groove, and moving the first plank with respect to the second plank from the intermediate position to the connected position, in which the distal protrusion and the proximal protrusion abut upwards respectively against the proximal lip and the distal lip of the connecting groove.

BRIEF DESCRIPTION OF THE SEVERAL VIEWS OF THE DRAWING(S)

Figure 2:
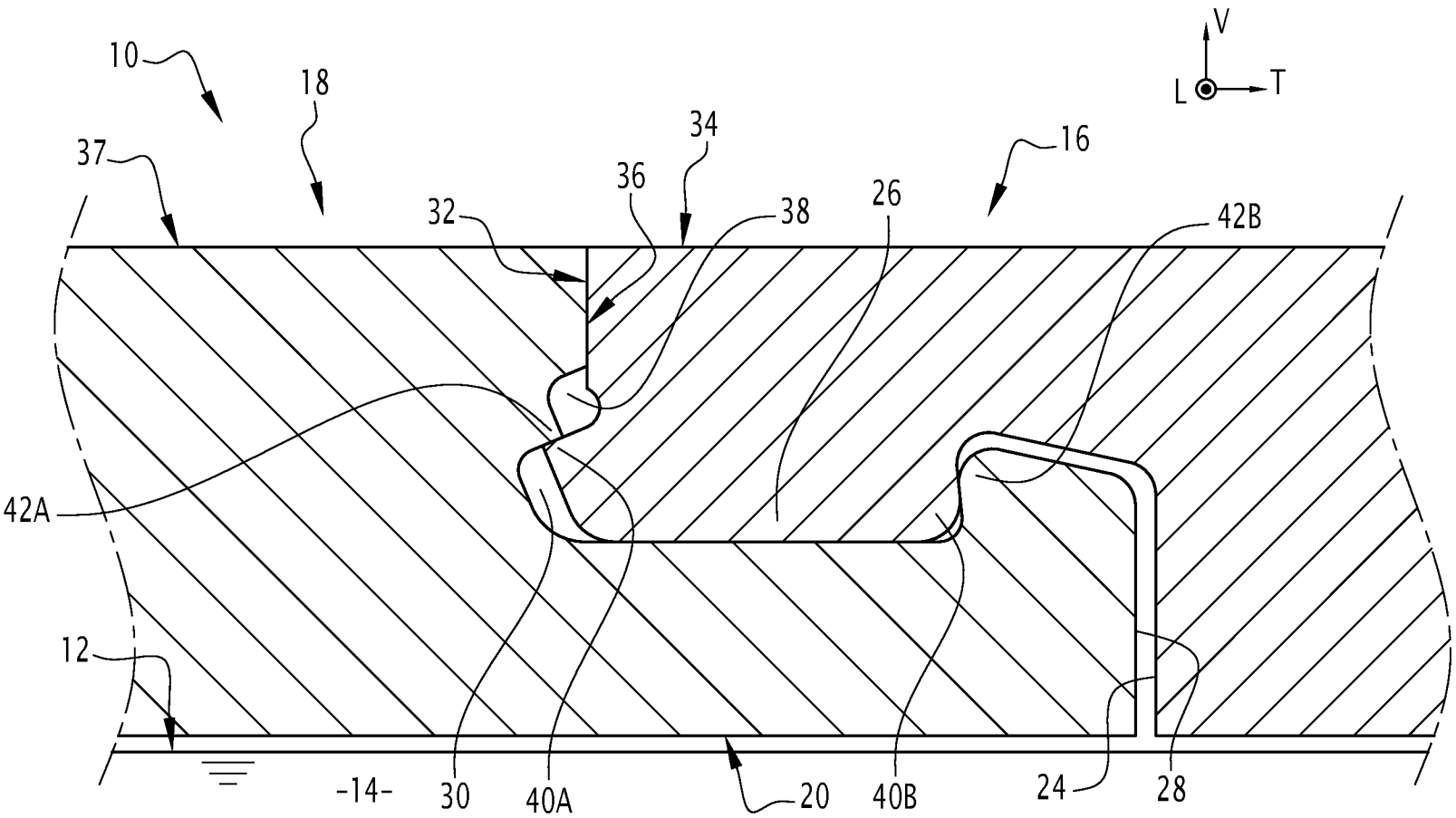
Figure 3:
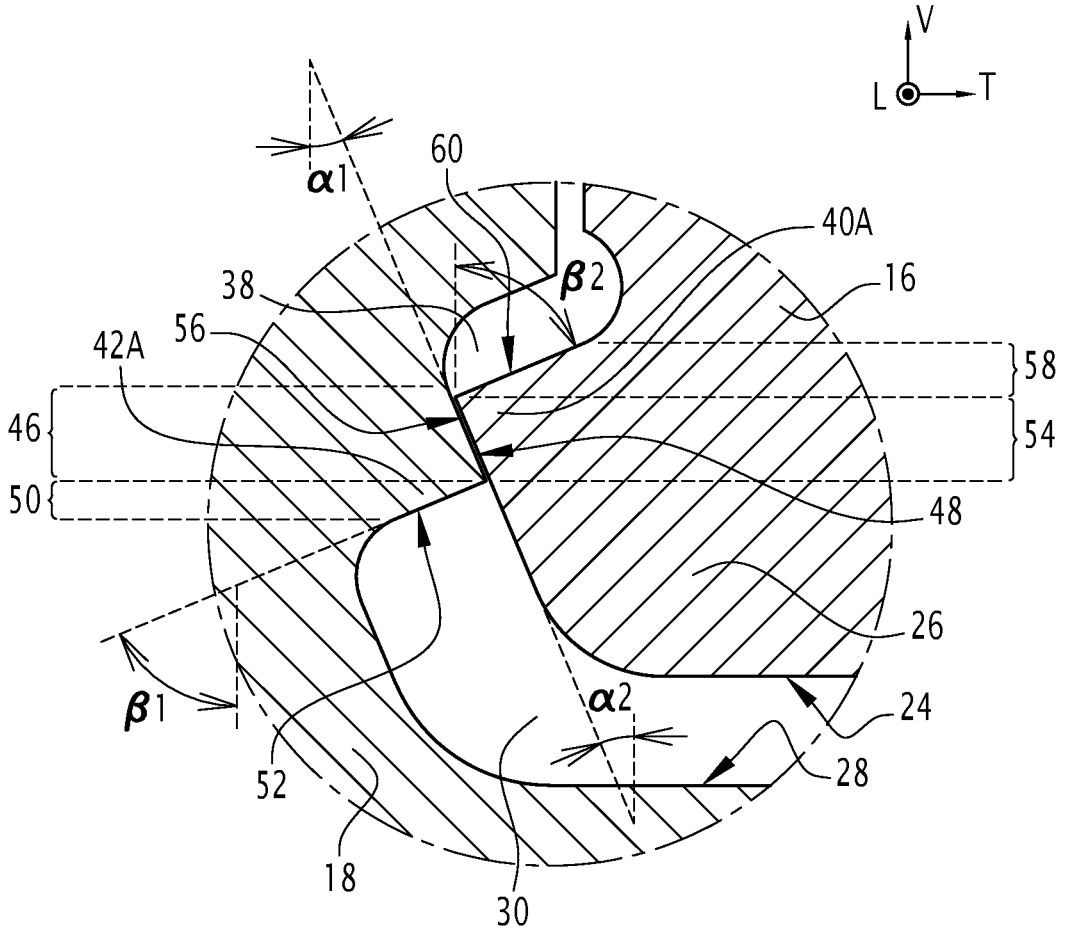
Figure 4:
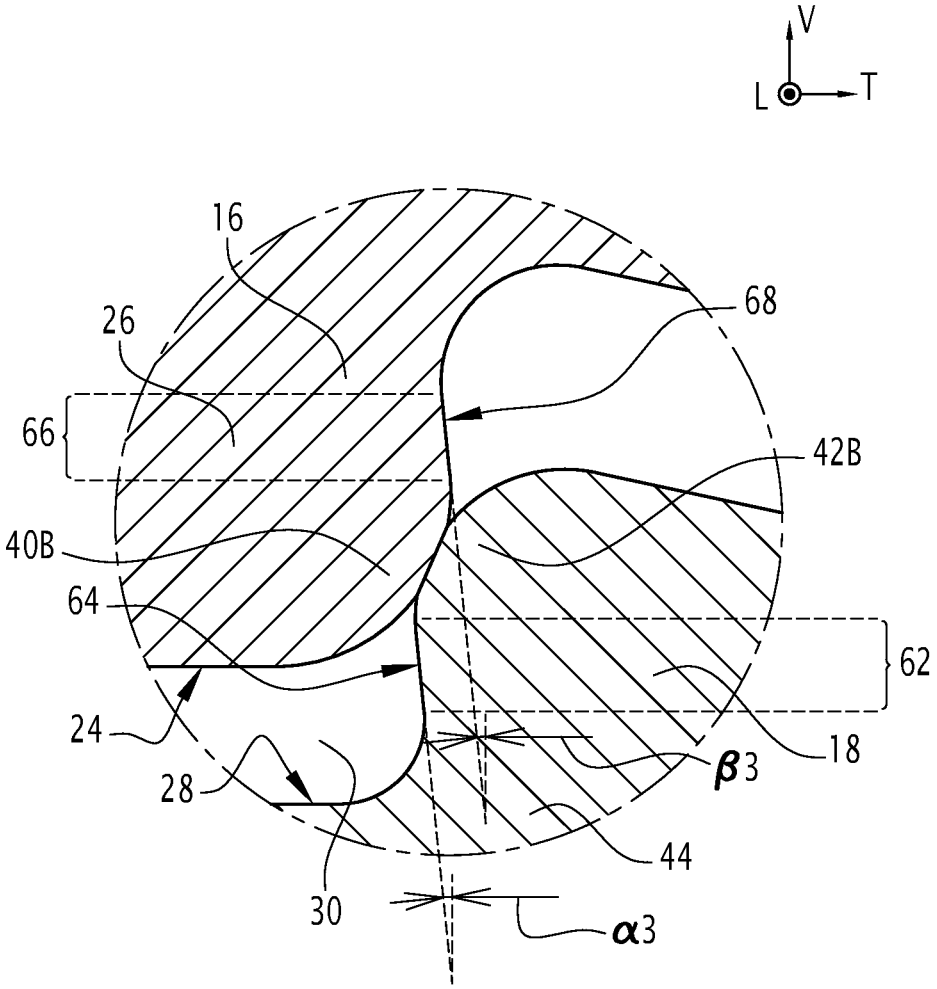
Figure 5:
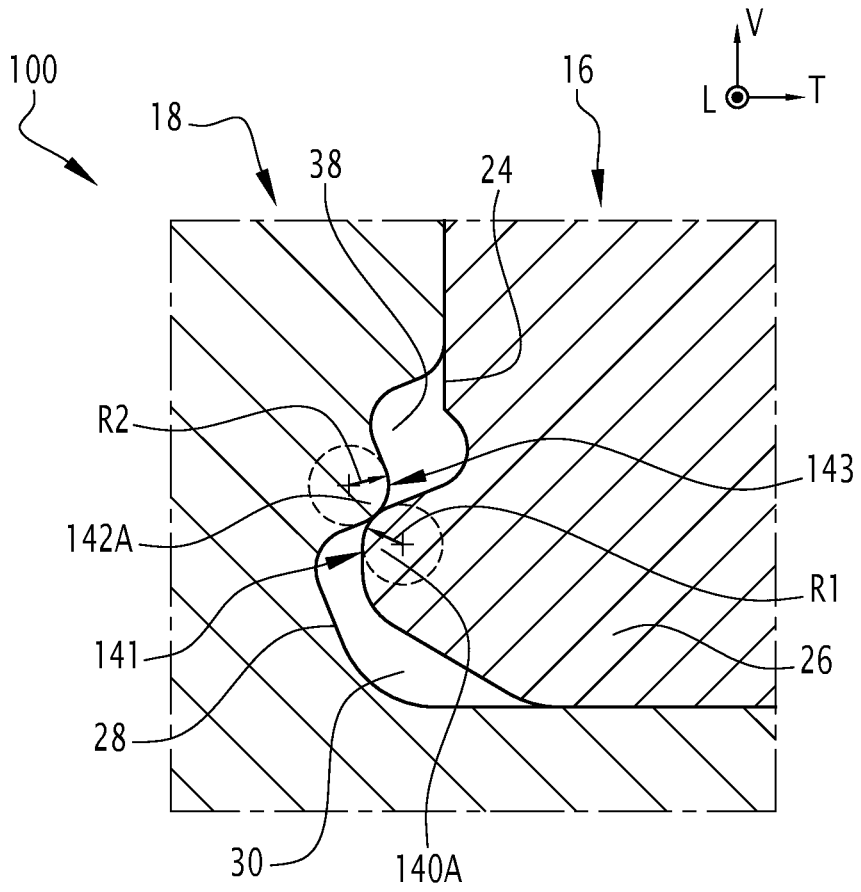
Figure 6:
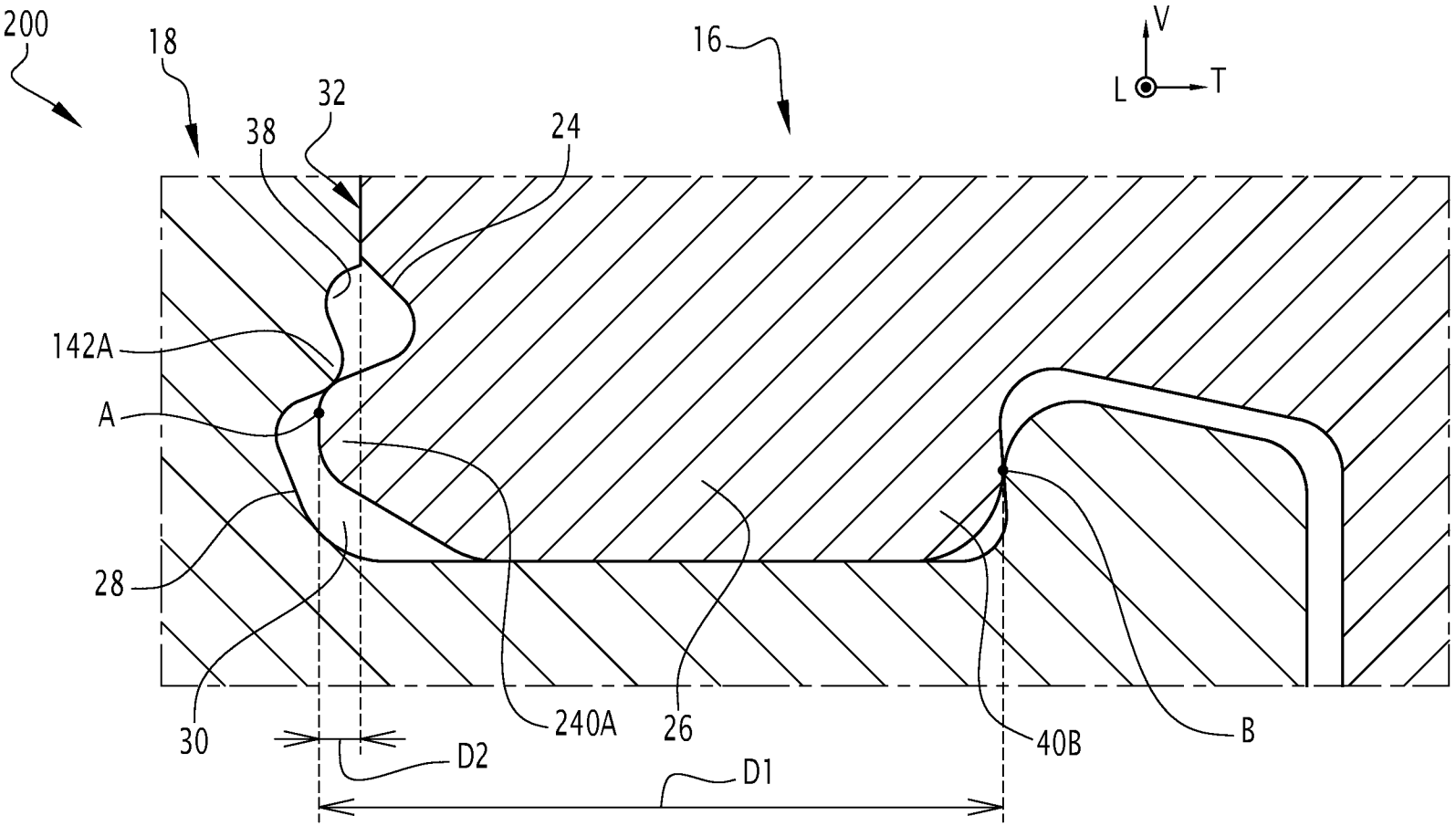
Figure 7:
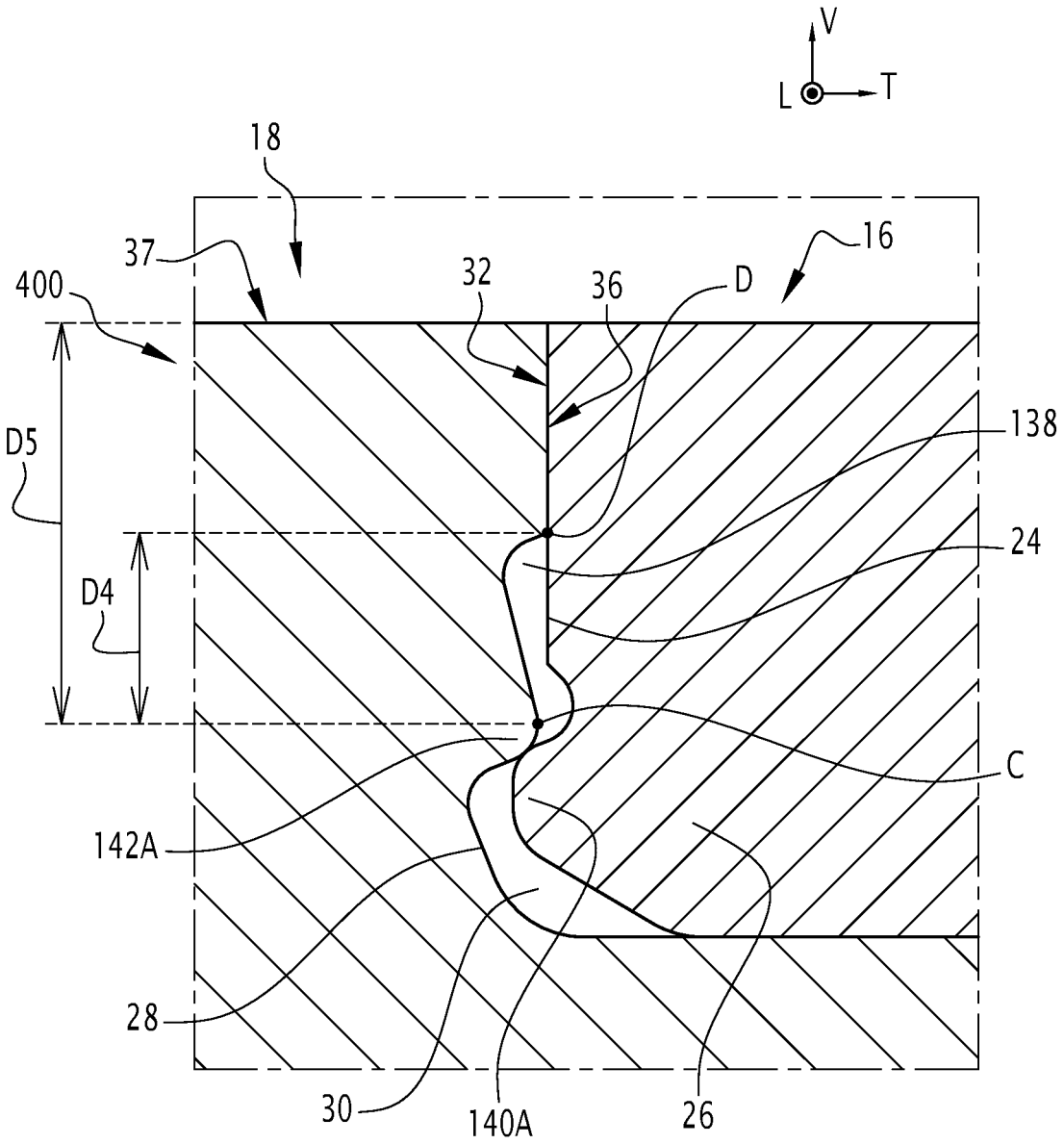

The invention and its advantages will be better understood upon reading the following description, given solely by way of example and with reference to the appended drawings, in which:

FIG. 1 is a schematic partial cross-sectional view of two planks of a set according to the invention, in the intermediate position, and FIG. 2 is a schematic partial cross-sectional view of the two planks shown in FIG. 1, in the connected position, FIG. 3 is an enlargement of FIG. 1 centered on the distal protrusion, FIG. 4 is an enlargement of FIG. 1 centered on the proximal protrusion, FIG. 5 is a schematic partial cross-sectional view of two planks of a set according to a first variant of the invention, in the connected position, the view being centered on the distal protrusion, FIG. 6 is a schematic partial cross-sectional view of two planks of a set according to a second variant of the invention, in the connected position, the view being centered on the connecting tongue, and FIG. 7 is a schematic partial cross-sectional view of two planks of a set according to a third variant of the invention, in the connected position, the view being centered on the distal protrusion up to the upper surface of the planks.

DETAILED DESCRIPTION OF THE INVENTION

With reference to FIGS. 1 and 2, a set of planks 10 according to the invention is described.

The set of planks 10 is adapted to cover a surface 12 for example defined by a floor 14 or a wall (not represented). The set of planks 10 comprises a plurality of planks, advantageously more than ten or fifty, of which a first plank 16 and a second plank 18 are represented on FIGS. 1 and 2.

The planks may be on site, as shown in FIG. 2, or may be in a packaged state (not represented), for example in subsets. Planks may be packaged in boxes or known equivalents.

The planks of the set of planks 10 may be identical to each other. For example, their shape is rectangular seen in their thickness direction V, which is vertical in the example shown in FIGS. 1 and 2. The planks have a lower face 20 in the thickness direction V intended to be in contact with the surface 12.

A variant, the thickness direction V is not vertical, but the terms "lower" and "upper", or "downwards" and "upwards" will be used with reference to the thickness direction V as if this direction was vertical, "lower" and "downwards" meaning "toward the face 20 intended to be in contact with the surface 12 to be covered".

In a particular embodiment, the planks are made of a plurality of layers 22 (FIG. 1) perpendicularly to the thickness direction V.

Though the planks 1 and 2 are similar in the example, some features will be described as part of the first plank 16, while some other features will be described as part of the second plank 18, in order to better explain how the planks 1 and 2 are connected to each other. In fact, both the first plank 16 and the second plank 18 have all these features in the example.

The first plank 16 has a first edge 24 extending in a longitudinal direction L perpendicular to the thickness direction V, and defining a connecting tongue 26.

The second plank 18 has a second edge 28 extending in the longitudinal direction L, and defining a connecting groove 30.

FIGS. 1 and 2 are cross sections perpendicularly to the longitudinal direction L.

A transverse direction T is also defined as perpendicular to the thickness direction V and to the longitudinal direction L.

The first plank 16 is movable with respect to the second plank between a disconnected position (not shown), in which the connecting tongue 26 is away from the connecting groove 30, an intermediate position (FIG. 1), and a connected position (FIG. 2), in which the connecting tongue 26 is snap-fit in the connecting groove 30.

The disconnected position can be obtained from FIG. 1 by moving the first plank 16 away from the second plank 2.

The first edge 24 and the second edge 28 advantageously form profiles in the longitudinal direction L.

The first edge 24 comprises an upper part 32 extending from an upper face 34 of the first plank 16 in the thickness direction V.

The second edge 28 comprises an upper part 36 extending from an upper face 37 of the second plank 18 in the thickness direction V, the upper parts 32, 36 being advantageously parallel to the thickness direction V.

The second edge 28 also defines a guiding recess 38.

The connecting tongue 26 comprises two protrusions 40A, 40B protruding in opposite senses in the transverse direction T, and including a transversely distal protrusion 40A with respect to the first plank 16 and a proximal protrusion 40B.

The connecting groove 30 defines a transversely proximal lip 42A and a transversely distal lip 42B with respect to the second plank 18.

In the intermediate position (FIG. 1), at least part of the distal protrusion 40A is transversely received in the guiding grove 38, and the proximal protrusion 40B abuts downwards against the distal lip 42B.

In the intermediate position, for example, the angle between the upper face 34 and the upper face 37 is smaller than 10°. Advantageously, the first plank 16 is approximately parallel to the second plank 18 in the intermediate position.

In the intermediate position, as shown in FIGS. 1 and 4, the proximal protrusion 40B and the distal lip 42B defines an overlap 44 comprised between 0.01 and 0.5 mm in the transverse direction.

The overlap 44 preferably has a transverse extension smaller than 0.15 mm, preferably smaller than 0.10 mm.

In the connected position (FIG. 2), the distal protrusion 40A and the proximal protrusion 40B are adapted to abut upwards respectively against the proximal lip 42A and the distal lip 42B.

As shown in FIGS. 1 and 3, the guiding recess 38 is located at least partly above the proximal lip 42A. For example, the guiding recess 38 is located above the connecting groove 30.

However, in the example, the proximal lip 42A of the connecting groove 30 also forms a lip of the guiding recess 38. In other words, in the example, the proximal lip 42A forms a transverse protrusion separating the connecting groove 30 and the guiding recess 38 in the thickness direction V.

Advantageously, a lower side 46 of the guiding recess 38 is at least partly defined by a surface 48 (FIG. 3) of the second edge 28, said surface 48 defining an angle α1 with the thickness direction V, the angle α1 being for example smaller than 45°.

Advantageously, a lower part 50 of the proximal lip 42A is at least partly defined by a surface 52 of the second edge 28, said surface 52 defining a locking angle β1 with the thickness direction V, the locking angle β1 being for example larger than 45°, preferably larger than 60°.

In the example, the proximal lip 42A and the distal protrusion 40A are pointy (FIG. 3), and the distal lip 42B and proximal protrusion 40B are round (FIG. 4).

Advantageously, a lower part 54 (FIG. 3) of the distal protrusion 40A is at least partly defined by a surface 56 of the first edge 24, said surface 56 defining an angle α2 with the thickness direction V, the angle α2 being for example smaller than 45°.

For example, the surface 56 is parallel to the surface 48 in the intermediate position.

Advantageously, an upper part 58 of the distal protrusion 40A is at least partly defined by a surface 60 of the first edge 24 , said surface 60 defining an angle β2 with the thickness direction V, the angle β2 being for example larger than 45°, preferably larger than 60°.

For example, the surface 60 is parallel to the surface 52 in the connected position.

Advantageously, a lower part 62 (FIG. 4) of the distal lip 42B is at least partly defined by a surface 64 of the second edge 28, said surface 64 defining a locking angle α3 with the thickness direction V, the locking angle α3 being for example smaller than 10°, preferably smaller than 5°.

Advantageously, an upper part 66 of the proximal protrusion 40B is at least partly defined by a surface 68 of the first edge 24, said surface 68 defining an angle β3 with the thickness direction V, the angle β3 being for example smaller than 10°, preferably smaller than 5°.

The locking angles α3 and β1 are adapted to provide a snap-fit effect advantageously on both sides of the connecting tongue 26 in the transverse direction T.

In the example, the angle β3, hence the locking angle α3, are quite small. As a consequence, the proximal protrusion 40B is rather discreet (does not protrude much).

From a practical point of view, the cross sectional shape of the guiding recess 38 (FIGS. 1 and 3) is advantageously designed to cooperate with the shape of the distal protrusion 40A. The distal protrusion 40A carries the two contact surfaces 56, 60, which are for example oriented between each other at an angle comprised between 45° and 135°.

Such a connecting system is provided on floor covering planks or wall covering planks made from rigid thermoplastic material (foamed or not foamed), plasticized thermoplastic material, mineral material, wood based material (engineered wood or High Density Fiber (HDF).

The operation of the set of planks 10 will now be described, which illustrates a method according to the invention.

Initially, the first plank 16 is in the disconnected position, that is to say away from the second plank 18.

Then the first plank 16 is moved from the disconnected position to the intermediate position. The distal protrusion 40A of the connecting tongue 26 is temporarily received transversely in the guiding recess 38. The proximal protrusion 40B abuts downwards against the distal lip 42B of the connecting groove 30, because of the overlap 44.

However, in the intermediate position, the guiding recess 38 enables to put the first plank 16 a bit more left (FIG. 1) than in the prior art, which explains why the overlap 44 is smaller than in the prior art. It is estimated that adding the guiding recess 38 allows reducing the overlap 44 at least by 20%, and generally by 50%, all other things being equal. Thanks to the guiding recess 38, it is then even possible to increase the transverse size of the distal protrusion 40A and therefore to increase the strength of the connection in the connected position.

The first plank 16 is then moved from the intermediate position to the connected position.

To do so, a vertical (in the example) pressure F1 is applied on the first plank 16 above the connecting tongue 26 in order to overcome the mechanical resistance created by the overlap 44. The pressure F1 is smaller than in the prior art, as the overlap 44 is smaller.

The distal protrusion 40A and the proximal protrusion 40B abut upwards respectively against the proximal lip 42A and the distal lip 42B of the connecting groove 30.

The locking angle β1 and, to a minor extent, the locking angle α3 ensure that the first plank 16 remains in the connected position.

Thanks to the above features, in particular the guiding recess 38, the resistance that the user has to overcome during connection is reduced, while the strength of the connection is maintained or even enhanced. The quality of the set of planks 10 is thus improved.

With reference to FIG. 5, a set of planks 100 according to a first variant of the invention will be described.

The set of planks 100 is analogous to the set of planks 10 shown in FIGS. 1 to 4. Similar elements bear the same numeral references and will not be described again. Only the differences will be described in detail hereafter.

The first plank 16 has distal protrusion 140A which is not pointy in the transverse direction T as the distal protrusion 40A of the set of planks 10, but round. For example, as shown in FIG. 6, the distal protrusion 140A has a profile 141 in the longitudinal direction L with a curvature radius R1 between 0.1 and 1.0 mm. In other words, the distal protrusion 140A is rounder than a cylinder (not shown) having a radius of 0.1 mm.

In a similar manner, the second plank 18 has distal lip 142A which is not pointy in the transverse direction T as the distal lip 42A of the set of planks 10, but round. For example, the distal lip 142A has a profile 143 in the longitudinal direction L with a curvature radius R2 between 0.1 and 1.0 mm. In other words, the distal lip 142A is rounder than a cylinder (not shown) having a radius of 0.1 mm.

These specific features allow a smoother installation of the second plank and reduce the risks of deterioration of the connecting tongue 26 and connecting groove 30 during installation in the connected position.

With reference to FIG. 6, a set of planks 200 according to a second variant of the invention will be described.

The set of planks 200 is analogous to the set of planks 100 shown in FIG. 5. Similar elements bear the same numeral references and will not be described again. Only the differences will be described in detail hereafter.

The first plank 16 has distal protrusion 240A which protrudes less in the transverse direction T than the distal protrusion 140A.

As measured along the transverse direction T, the distance D1 between a transversely extreme point A of the distal protrusion 240A and a transversely extreme point B of the proximal protrusion 40B defines a length of the connecting tongue 26.

For example, still measured along the transverse direction T, the distance D2 between point A and the upper part 32 of the first plank 16 is smaller than 10%, preferably 5%, of the distance D1.

These specific features allow a smoother installation of the second plank and reduce the risks of deterioration of the connecting tongue 26 and connecting groove 30 during installation in the connected position.

With reference to FIG. 7, a set of planks 400 according to a third variant of the invention will be described.

The set of planks 400 is analogous to the set of planks 100 shown in FIG. 5. Similar elements bear the same numeral references and will not be described again. Only the differences will be described in detail hereafter.

The second edge 28 defines a guiding recess 138 that is longer in the thickness direction V than the guiding recess 38 of the set of planks 100 shown in FIG. 5.

For example, the distance D4, as measured along the thickness direction V, between a transversely extreme point C of the distal lip 142A and a point D, where the guiding recess 38 and the upper part 36 meet, is greater than 30% of the distance D5 between point C and the upper face 37 of the second plank 18.

These specific features allow a smoother installation of the second plank and reduce the risks of deterioration of the connecting tongue 26 and connecting groove 30 during installation in the connected position.

The invention claimed is:

1. A set of planks adapted to cover a surface perpendicular to a thickness direction of the planks, the planks having a lower face in the thickness direction intended to be in contact with the surface, said set of planks comprising at least a first plank having a first edge extending in a longitudinal direction perpendicular to the thickness direction, and a second plank having a second edge extending in the longitudinal direction, the second edge defining a connecting groove, and the first edge defining a connecting tongue, the first plank being movable with respect to the second plank between a disconnected position, in which the connecting tongue is away from the connecting groove, and a connected position, in which the connecting tongue is snap-fit in the connecting groove, the connecting tongue comprising two protrusions protruding in opposite senses in a transverse direction perpendicular to the thickness direction and to the longitudinal direction, the two protrusions including a transversely distal protrusion with respect to the first plank and a transversely proximal protrusion, the distal protrusion and the proximal protrusion being adapted to abut upwards in the connected position respectively against a transversely proximal lip and a transversely distal lip of the connecting groove, wherein the second edge further defines a guiding recess at least partly located above the proximal lip and adapted to receive the distal protrusion transversely in an intermediate position of the first plank, in which the proximal protrusion abuts downwards against the distal lip, and wherein the guiding recess is defined with respect to an upper part of the second edge.

2. The set of planks according to claim 1, wherein, in the intermediate position, the first plank is approximately parallel to the second plank.

3. The set of planks according to claim 1, wherein, in the intermediate position, the proximal protrusion and the distal lip defines an overlap having a transverse extension smaller than 0.15 mm.

4. The set of planks according to claim 1, wherein a lower side of the guiding recess is at least partly defined by a surface of the second edge, said surface defining an angle with the thickness direction, the angle being smaller than 45°.

5. The set of planks according to claim 1, wherein a lower part of the proximal lip is at least partly defined by a surface of the second edge, said surface defining an angle with the thickness direction, the angle being larger than 45°.

6. The set of planks according to claim 1, wherein the proximal lip of the connecting groove also forms a lip of the guiding recess.

7. The set of planks according to claim 1, wherein:

the proximal lip and the distal protrusion are pointy with a radius of curvature smaller than 0.1 mm, and the distal lip and proximal protrusion are round with a radius of curvature greater than or equal to 0.1 mm.

8. The set of planks according to claim 1, wherein the first edge and the second edge respectively comprise upper parts extending from upper faces of the first plank and the second plank in the thickness direction, the upper parts being parallel to the thickness direction.

9. The set of planks according to claim 1, wherein a lower part of the distal protrusion is at least partly defined by a surface of the first edge, said surface defining an angle with the thickness direction, the angle being smaller than 45°.

10. The set of planks according to claim 1, wherein an upper part of the distal protrusion is at least partly defined by a surface of the first edge, said surface defining an angle with the thickness direction, the angle being larger than 45°.

11. The set of planks according to claim 1, wherein a lower part of the distal lip is at least partly defined by a surface of the second edge, said surface defining an angle with the thickness direction, the angle being smaller than 10°.

12. The set of planks according to claim 1, wherein an upper part of the proximal protrusion is at least partly defined by a surface of the first edge, said surface defining an angle with the thickness direction, the angle being smaller than 10°.

13. The set of planks according to claim 1, comprising at least one layer made from a rigid thermoplastic material, a plasticized thermoplastic material, a mineral material, or a wood based material.

14. A method of connecting the set of planks according to claim 1, comprising:

moving the first plank with respect to the second plank from the disconnected position to the intermediate position, in which the distal protrusion is received transversely in the guiding recess and the proximal protrusion abuts downwards against the distal lip of the connecting groove, and moving the first plank with respect to the second plank from the intermediate position to the connected position, in which the distal protrusion and the proximal protrusion abut upwards respectively against the proximal lip and the distal lip of the connecting groove.

* * * * *